US005084984A

United States Patent [19]

Duchoud et al.

[11] Patent Number: 5,084,984

[45] Date of Patent: Feb. 4, 1992

[54] NAIL-DRYER

[75] Inventors: Christian Duchoud, Marigny Saint Marcel; Serge Briee, Bloye, both of France

[73] Assignee: Yves Saint Laurent Parfums, Neuilly Sur Seine, France

[21] Appl. No.: 735,257

[22] Filed: Jul. 24, 1991

[30] Foreign Application Priority Data

Jul. 31, 1990 [FR] France ..... 90 10008

[51] Int. Cl.[5] ..... F26B 19/00

[52] U.S. Cl. ..... 34/48; 34/90; 34/201; 34/202; 219/507; 392/381; 392/360; 392/379

[58] Field of Search ..... 34/90, 201, 202, 243 R, 34/48, 55; 219/507, 524; 392/360, 363, 364, 365, 379, 380, 381, 383, 384, 385

[56] References Cited

U.S. PATENT DOCUMENTS

| | | | |
|---|---|---|---|
| 2,184,858 | 12/1939 | Goodman | 34/202 |
| 2,260,687 | 10/1941 | Lasha | 34/202 |
| 2,490,019 | 12/1949 | Elliot | 34/202 |
| 3,287,824 | 11/1966 | Selditz | 34/202 |
| 3,586,820 | 6/1971 | Yamanaka | 219/507 |
| 3,864,847 | 2/1975 | Friedman et al. | 34/202 |
| 3,930,320 | 1/1976 | Henderson | 34/202 |
| 3,953,710 | 4/1976 | Dyer | 392/384 |
| 4,754,769 | 7/1988 | Flynn | 34/202 |

FOREIGN PATENT DOCUMENTS

| | | |
|---|---|---|
| 2177682 | 1/1987 | United Kingdom . |
| 2177300 | 1/1987 | United Kingdom . |

*Primary Examiner*—Henry A. Bennett
*Assistant Examiner*—Denise L. F. Gromada
*Attorney, Agent, or Firm*—Pollock, VandeSande & Priddy

[57] ABSTRACT

A clamshell housing encloses a nail dryer. The housing includes a cover pivotally connected to a base. The cover may be opened by applying leverage to it and exposing a nail drying zone. The cover may be pivotally closed to form a compact package when not in use. A nail drying fan is actuated when the cover is opened thus closing an electrical circuit. The electrical connection is interrupted when the cover is tipped into a closed position.

9 Claims, 6 Drawing Sheets

NAIL-DRYER

The present invention relates to devices enabling nail varnish applied to fingernails or toenails to be dried more quickly.

Devices enabling nail varnish to be dried are already known, constituted by a body made in a single piece comprising an open part forming a receptacle for the fingertips of one hand and containing an electric motor supplied by an independent source of electric power and carrying fan blades, the fan blades causing the intake of air into the body made in a single piece through an inlet and the expulsion of air through an outlet in the direction of the receptacle. During use, it is necessary to control the power supply to the electric motor for the rotation of the fan blades by actuating an electric switch accessible by a push-button from outside the body. The switch is normally operated by pressing with a finger.

A first disadvantage possessed by these known devices is the fact that it is necessary to activate the push-button of the electric switch, which is an operation that risks damaging the fresh varnish applied to the nails, and risks causing the varnish to be applied to that part of the body surrounding the push-button of the switch to be activated.

A second disadvantage of the known devices is their bulk, because of the fact that the receptacle permanently forms a voluminous hollow region surrounded by an upper part of the body and a lower part of the body so that, when not being used, the whole assemblage has a large volume, ill-suited to being carried in a handbag.

The particular aim of the present invention is to avoid the disadvantages of the known devices by proposing a new structure for a nail-dryer in which control of the starting and stopping can be achieved without the risk of damaging the fresh varnish applied to the nails: the control of the starting and stopping can be provided by a push from the palm or the inner surface of the hand on the upper surface of the nail-dryer body. The control can also be provided by pressure from the lower surface of the foot on the top of the nail-dryer.

Another aim of the invention is to allow a substantial reduction in the volume of the nail-dryer when not being used.

Another aim of the invention is to devise a structure for a nail-dryer such that it is particularly simple, and hence can be produced cheaply, while remaining particularly reliable.

In order to attain these aims, as well as others, the nail-dryer according to the invention comprises a hollow body in which are mounted:

fan blades coupled to the end of the shaft of an electric motor, an independent electric power supply;

means of electrical connection for the electrical connection of the said motor to the said independent electric power supply;

an air inlet for admitting air sucked in by the blades;

an air outlet providing an exit for the air driven by the blades and directed towards a drying zone intended to receive the fingertips or ends of toes of the user;

according to the invention:

the hollow body is in two parts hinged to each other, namely a base and a cover, the base is shaped in such a way as to rest on a support, the cover covers at least part of the base, the cover is hinged to the base along a transverse axis allowing it to pivot so as to accommodate at least one open position in which the cover allows access to a drying zone located between the base and the cover, and a closed position in which the cover covers the base and the said drying zone, means of electrical connection, comprising means for switching connected in series between the independent power supply and the motor, are actuated by the cover so as to establish the electrical connection and supply the motor when the cover is tipped into the open position, and so as to break the electrical connection and cut off the power supply to the motor when the cover is tipped into the closed position.

The nail-dryer according to the invention is preferably such that:

the transverse axis on which the cover is hinged to the base is located in an intermediate region of the cover and the base, separating respective front portions of the base and the cover and respective rear portions of the base and the cover, when the cover is in the closed position, the front portion of the cover is near the front portion of the base, when the cover is in the open position, the front portion of the cover is separated from the front portion of the base so as to form the drying zone, tipping the cover towards its open position is achieved by pushing, with the hand or foot, the rear portion of the cover towards the base, tipping the cover towards its closed position is achieved by pushing the front part of the cover towards the base.

Other subjects, characteristics and advantages of the present invention will emerge from the following description of particular modes of embodiment, given with reference to the appended drawings, in which:

FIG. 1 is a longitudinal cross-sectional side view of a nail-dryer according to the present invention in an open position;

FIG. 2 is a longitudinal cross-sectional side view of the nail-dryer of FIG. 1 in a closed position;

FIG. 3 is a side view of the nail-dryer according to the present invention in an open position;

FIG. 4 is a side view of the nail-dryer according to the invention in a closed position;

FIG. 5 is a front view of the nail-dryer according to the invention in a closed position; and FIG. 6 is a plan view of the nail-dryer according to the invention in a closed position.

In the mode of embodiment represented in the figures, the nail-dryer according to the invention comprises a hollow body 1 in two parts hinged to each other, namely a base 2 and a cover 3. The base 2 has a flat bottom 4 shaped so that it can rest on a support such as the ground. The cover 3 must cover at least a part of the base 2; in the mode of embodiment represented, the cover 3 has a size that enables it to cover almost the whole of the upper surface of the base 2.

The transverse axis I—I on which the cover 3 is hinged to the base 2 is located in an intermediate region of the cover and the base. It is thus possible to distinguish between a front portion 5 of the base 2 in front of the hinge axis I—I and a rear portion 6 of the base 2 behind the hinge axis I—I; similarly, it is possible to distinguish between a front portion 7 of the cover 3 in front of the hinge axis I—I and a rear portion 8 of the cover 3 behind the hinge axis I—I.

When the cover is in the closed position shown in FIG. 2, the front portion 7 of the cover 3 is close to the front portion 5 of the base 2. On the other hand, when the cover 3 is in the open position shown in FIG. 1, obtained by tipping the cover 3 about its hinge axis I—I, the front portion 7 of the cover 3 is separated from the front portion 5 of the base 2 so as to form a space open to the outside and forming a drying zone 9. The drying zone 9 is of a size sufficient to receive and hold the end of the hand or foot carrying the varnished nails.

In the mode of embodiment represented, the hinge axis I—I of the cover 3 is, with advantage, located near the rear third of the cover 3 and the base 2. In this way, it is possible to define a drying zone 9 with relative large dimensions.

An electric motor 10 is mounted in the cover 3 and its output shaft 11, which is vertical, carries fan blades 12 as shown in FIGS. 1 and 2. An air inlet 13 is made in the upper wall of the cover 3 opposite the blades 12. An outlet 14 is made in the inner wall of the cover 3, in a peripheral position in relation to the blades 12 and in the portion communicating with the drying zone 9. Thus, when the motor 10 rotates, the blades 12 produce an intake of air through the inlet 13 as represented by the arrow 15, and an expulsion of air through the outlet 14 as represented by the arrow 16.

An independent source of electric power, such as dry cells or a battery, is mounted in the base 2, for example in the rear portion 6 of the base. Electrical conductors, not shown in the figures, conduct the electric power from the independent electric power supply to the electric motor 10. Means for switching, connected in series between the power supply and the motor 10, enable the power supply to the motor 10 to be connected or disconnected depending on the position of the cover 3. The means for switching comprise, with advantage, flexible conducting contact strips attached to one part of the body, namely the cover 3 or the base 2, and so arranged as to come into contact with electric conductors attached to the other part of the body when the cover is in the open position, and so as not to be in contact with the said electric conductors when the cover is in the closed position.

For example, in the mode of embodiment represented in FIGS. 1 and 2, the motor 10 includes two input electric conductors 17 on its lower surface. Two flexible conducting strips 18 are disposed on the base 2 opposite the respective conductors 17. When the cover 3 is tipped between its closed and open positions, the motor 10 is displaced with respect to the flexible conducting strips 18: in the closed position, represented in FIG. 2, the conductors 17 are separated from the flexible conducting strips 18; on the other hand, in the open position represented in FIG. 1, the conductors 17 come into contact with the flexible conducting strips 18. The flexible conducting strips 18 are connected electrically to the independent electric power supply.

In a simplified mode of embodiment, it is possible to provide for one of the output conductors 17 from the motor 10 to be permanently connected to the independent electric power supply, while the other output conductor 17 cooperates with one flexible conducting strip 18 to connect or disconnect the power supply to the motor 10.

In the mode of embodiment which has been represented, the motor 10 is located slightly behind the hinge axis I—I of the cover 3.

The device operates as follows:

in the closed position, represented in FIG. 2, the device occupies little space since the cover 3 completely covers the upper part of the base 2 and the drying zone 9 is eliminated;

in order to cause the device to function as a nail-dryer, the user can press on the upper surface of the cover 3 in the rear portion 8 with the flat of the hand or the sole of the foot as represented by the arrow 19; through this pressure, the cover 3 is tipped around its transverse hinge axis I—I and comes into the open position represented in FIG. 1;

in the open position, electrical connection is made by the contact of the conductors 17 on the flexible conducting strips 18 so as to supply power to the motor 10 which, by its rotation, produces a flow of air injected into the drying zone 9;

the user can place the hand or the foot flat on the front portion 5 of the base 2, the nails then being in the drying zone 9 and subjected to the drying action of the air blown in by the blades 12;

after drying, the user can reclose the device by exerting a pressure on the upper part of the front portion 7 of the cover 3, as represented by the arrow 20, causing the cover 3 to tip towards its closed position represented in FIG. 2;

the power supply to the motor 10 is then automatically cut off by the separation of the conductors 17 away from the flexible conducting strips 18.

According to the invention, it is possible with advantage to provide a hinge axis I—I defined by components which interconnect, making it possible, after pivoting the cover to open it, to disconnect the hinge pin so as to allow the cover 3 to be completely raised and moved apart from the base 2; in this position, access is provided to the inside of the device in order to change the cells forming the independent power supply.

It is possible, without going outside the scope of the invention, to envisage a slightly different arrangement by mounting the motor 10 and the blades 12 on the base 2 in a fixed position. It is also necessary to provide electric conductors and flexible strips to ensure the connection and disconnection of the electric power supply to the motor as a function of the position of the cover 3.

The present invention is not limited to the modes of embodiment which have been explicitly described, but it includes in it the different variants and generalisations lying within the scope of the claims below.

We claim:

1. Nail-dryer comprising a hollow body (1) in which are mounted:

fan blades (12) coupled to the end of the shaft (11) of an electric motor (10), an independent electric power supply;

means of electrical connection (17, 18) for the electrical connection of the said motor (10) to the said independent electric power supply;

an air inlet (13) for admitting air sucked in by the blades (12);

an air outlet (14) providing an exit for the air driven by the blades (12) and directed towards a drying zone (9) intended to receive the fingertips or ends of toes of the user, characterised in that:

the hollow body (1) is in two parts hinged to each other, namely a base (2) and a cover (3), the base (2) is shaped in such a way as to rest on a support, the cover (3) covers at least part of the base (2), the cover (3) is hinged to the base along a transverse axis (I—I) allowing it to pivot so as to accommodate at least one open position in which the cover (3) allows access to a drying zone (9) located between the base (2) and the cover (3), and a closed position in which the cover (3) covers the base (2) and the said drying zone (9), means of electrical connection, comprising means for switching (17, 18) connected in series between the independent power supply and the motor (10), are actuated by the cover (3) so as to establish the electrical connection and supply the motor (10) when the cover (3) is tipped into the open position, and so as to break the electrical connection and cut off the power supply to the motor (10) when the cover (3) is tipped into the closed position.

2. Nail-dryer according to claim 1, characterised in that:

the transverse axis (I—I) on which the cover (3)is hinged to the base (2) is located in an intermediate region of the cover (3) and the base (2), separating respective front portions of the base (5) and the cover (7) and respective rear portions of the base (6) and the cover (8), when the cover (3) is in the closed position, the front portion of the cover (7) is near the front portion of the base (5), when the cover (3) is in the open position, the front portion of the cover (7) is separated from the front portion of the base (5) so as to form the drying zone (9), tipping the cover (3) towards its open position is achieved by pushing, with the hand or foot of the user, the rear portion (8) of the cover towards the base (2), tipping the cover towards its closed position is achieved by pushing the front part of the cover (7) towards the base (2).

3. Nail-dryer according to claim 2, characterised in that the hinge axis (I—I) of the cover (3) is located near the rear third of the cover (3) and the base (2).

4. Nail-dryer according to claim 3, characterised in that the motor (10) and the blades (12) are fitted into the cover (3), while the independent power supply is mounted in the base (2).

5. Nail-dryer according to claim 3, characterised in that the motor (10), the blades (12) and the independent power supply are mounted in the base (2).

6. Nail-dryer according to claim 5, characterised in that the means for switching comprise at least one flexible conducting contact strip (18) attached to one part of the body and so arranged as to come into contact with at least one electric conductor (17) attached to the other part of the body when the cover (3) is in the open position, and so as not to be in contact with the said electric conductor (17) when the cover (3) is in the closed position.

7. Nail-dryer according to claim 6, characterised in that the flexible conducting contact strip (18) is fixed to the base (2) and comes into contact with an output conductor (17) from the motor (10) when the cover (3) is in the open position.

8. Nail-dryer according to claim 7, characterised in that the motor (10) is located slightly behind the hinge axis (I—I) of the cover (3).

9. Nail-dryer according to claim 1, characterised in that the cover (3) is removable by disconnecting the hinge pin so as to provide access to the inside in order to change the cells forming the independent power supply.

* * * * *

UNITED STATES PATENT AND TRADEMARK OFFICE

CERTIFICATE OF CORRECTION

PATENT NO. : 5,084,984

DATED : February 4, 1992

INVENTOR(S) : Christian Duchoud, et al.

It is certified that error appears in the above-identified patent and that said Letters Patent is hereby corrected as shown below:

Column 1, between lines 3 and 4, insert and center the heading

--FIELD OF THE INVENTION--;

between lines 6 and 7, insert and center the heading

--BRIEF DESCRIPTION OF THE PRIOR ART--;

between lines 33 and 34, insert and center the heading

--BRIEF DESCRIPTION OF THE INVENTION--;

line 36, delete "the";

line 38, change "nails: the" to --nails. The--;

line 39, delete "the";

line 63, change ";" to --,--;

line 64, change "according" to --According--.

Column 2, between lines 37 and 38, insert and center the heading

--BRIEF DESCRIPTION OF THE FIGURES--;

UNITED STATES PATENT AND TRADEMARK OFFICE

CERTIFICATE OF CORRECTION

PATENT NO. : 5,084,984

DATED : February 4, 1992

Figure 1:
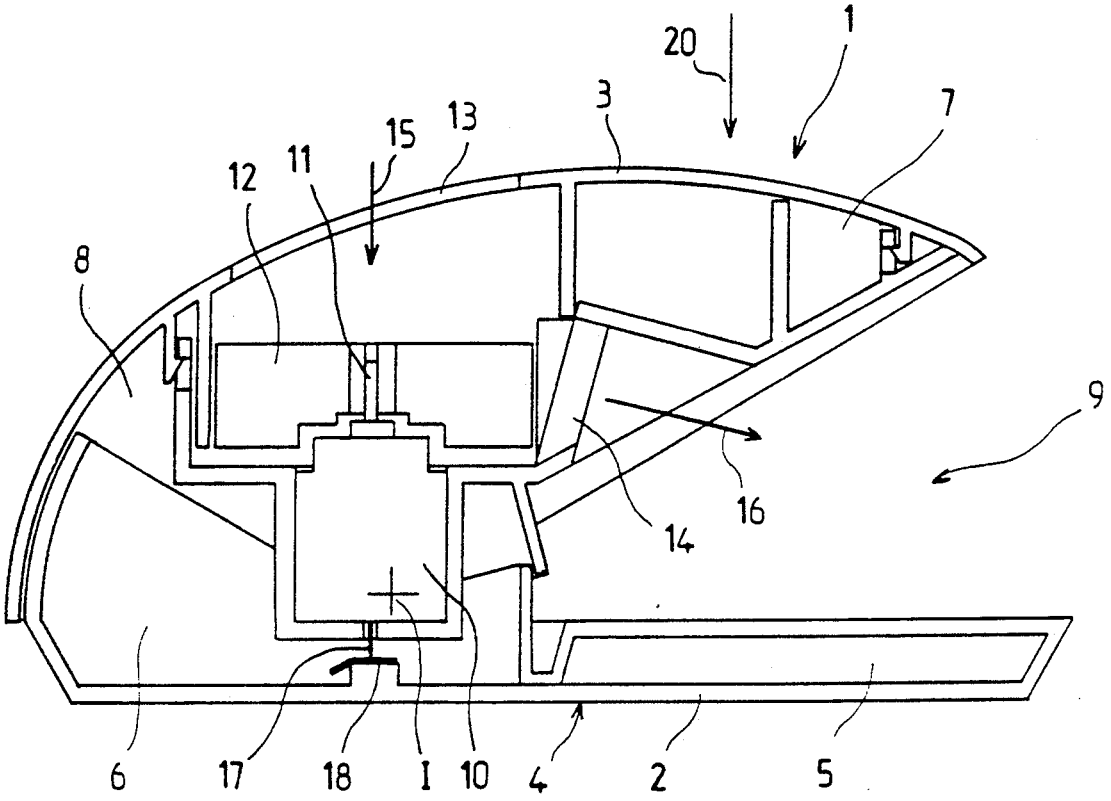
Figure 2:
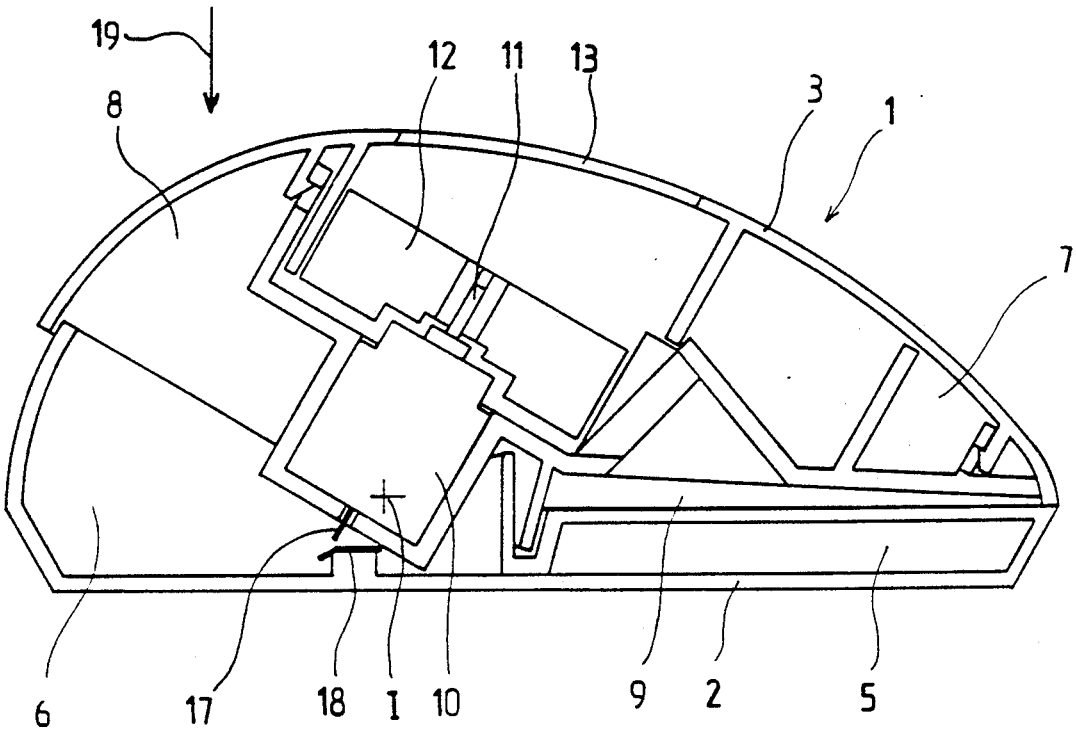
Figure 3:
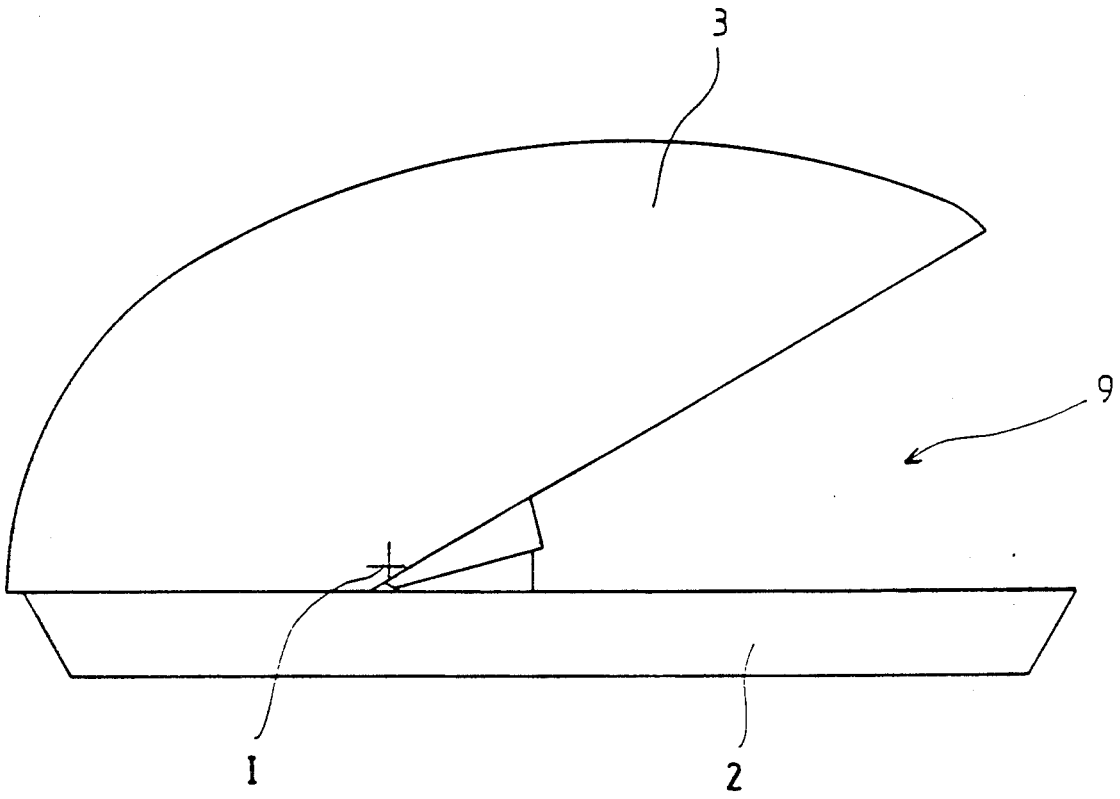
Figure 4:
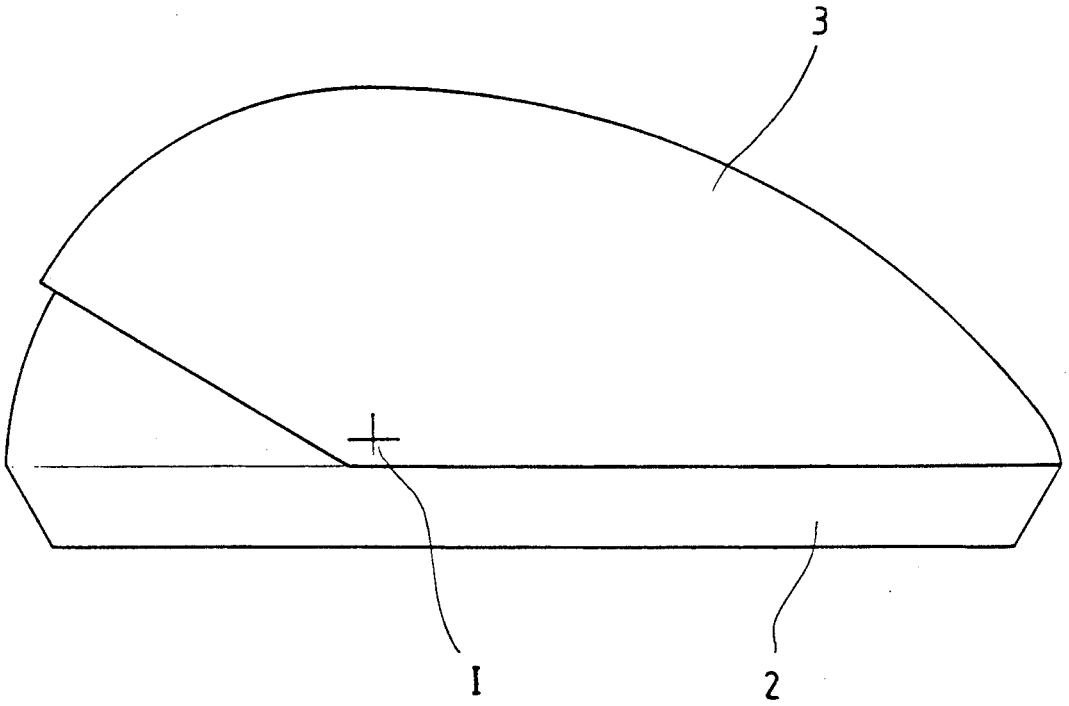
Figure 5:
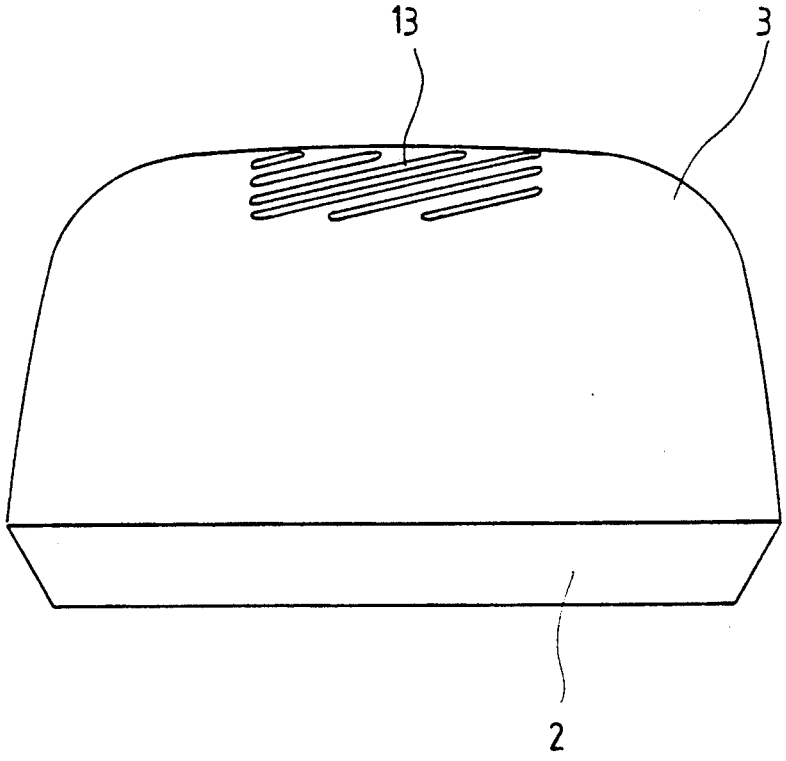
Figure 6:
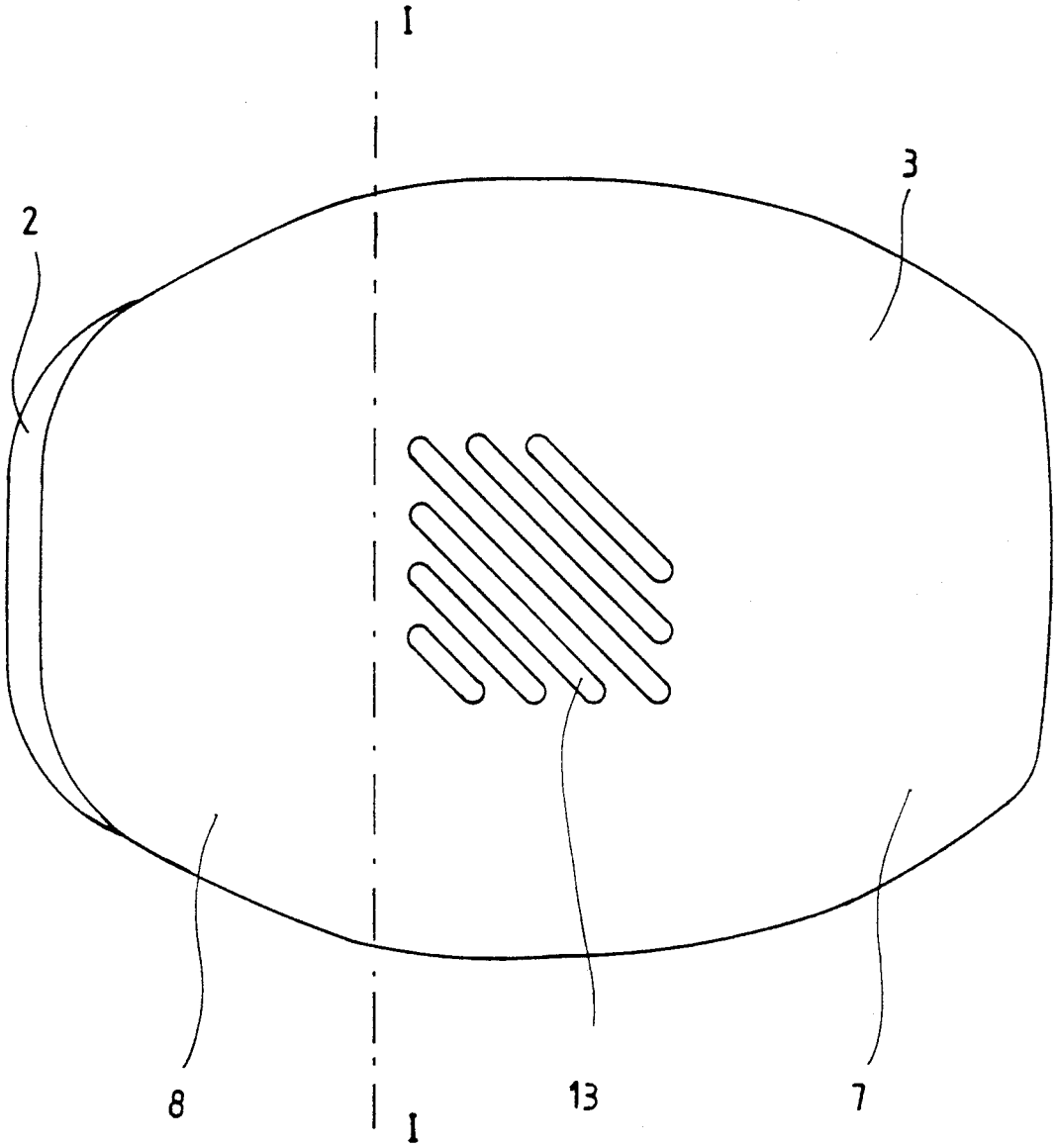

INVENTOR(S) : Christian Duchoud, et al.

It is certified that error appears in the above-identified patent and that said Letters Patent is hereby corrected as shown below:

Column 2, between lines 50 and 51, insert and center the heading

--DETAILED DESCRIPTION OF THE INVENTION--.

Column 3, line 51, change "18: in" to --18. In--.

Column 4, line 50, delete "(1)";

line 52, delete "(12)" and delete "(11)";

line 53, delete "(10)";

line 55, delete "(17, 18)";

line 56, delete "(10)";

line 58, delete "(13)";

line 59, delete "(12)";

line 60, delete "(14)";

line 61, delete "(12)";

line 62, delete "(9)";

line 64, delete "(1)";

line 65, delete "(2)" and delete "(3)";

line 66, delete "(2)";

line 68, delete "(3)" and delete "(2)".

UNITED STATES PATENT AND TRADEMARK OFFICE

CERTIFICATE OF CORRECTION

PATENT NO. : 5,084,984

DATED : February 4, 1992

INVENTOR(S) : Christian Duchoud, et al.

It is certified that error appears in the above-identified patent and that said Letters Patent is hereby corrected as shown below:

Column 5, line 1, delete "(3)";

line 4, delete "(3)" and delete "(9)";

line 5, delete "(2)" and delete "(3)";

line 6, delete "(3)" and delete "(2)";

line 7, delete "(9)";

line 9, delete "(17, 18)";

line 10, delete "(10)";

line 11, delete "(3)";

line 12, delete "(10)";

line 13, delete "(3)";

line 15, delete "(10)";

line 16, delete "(3)";

line 19, delete "(3)";

line 20, delete "(2)";

line 21, delete "(3)" and delete "(2)";

line 22, delete "(5)";

UNITED STATES PATENT AND TRADEMARK OFFICE

CERTIFICATE OF CORRECTION

PATENT NO. : 5,084,984

DATED : February 4, 1992

INVENTOR(S) : Christian Duchoud, et al.

It is certified that error appears in the above-identified patent and that said Letters Patent is hereby corrected as shown below:

Column 5, line 23, delete "(7)";

line 24, delete "(6)" and delete "(8)";

line 25, delete "(3)";

line 26, delete "(7)";

line 27, delete "(5)";

line 28, delete "(3)";

line 29, delete "(7)";

line 30, delete "(5)";

line 31, delete "(9)";

line 32, delete "(3)";

line 34, delte "(8)";

line 35, delete "(2)".

Column 6, line 3, delete "(2)";

line 5, delete "(3)";

line 6, delete "(3)" and delete "(2)";

line 8, delete "(10)" and delete "(12)";

UNITED STATES PATENT AND TRADEMARK OFFICE

CERTIFICATE OF CORRECTION

PATENT NO. : 5,084,984

DATED : February 4, 1992

INVENTOR(S) : Chrustian Duchoud, et al.

It is certified that error appears in the above-identified patent and that said Letters Patent is hereby corrected as shown below:

Column 6, line 9, delete "(3)";

line 10, delete "(2)";

line 12, delete "(10)" and delete "(12)";

line 13, delete "(2)";

line 16, delete "(18)";

line 18, delete "(17)";

line 19, delete "(3)";

line 21, delete "(17)" and delete "(3)";

line 25, delete "(18)" and delete "(2)";

line 26, delete "(17)";

line 27, delete "(10)" and delete "(3)";

line 30, delete "(10)";

UNITED STATES PATENT AND TRADEMARK OFFICE

CERTIFICATE OF CORRECTION

PATENT NO. : 5,084,984

DATED : February 4, 1992

INVENTOR(S) : Christian Duchoud, et al

It is certified that error appears in the above-indentified patent and that said Letters Patent is hereby corrected as shown below:

Column 6, line 31, delete "(3)";

line 33, delete "(3)".

Signed and Sealed this

Twenty-eighth Day of December, 1993

*Attest:*

Bruce Lehman

BRUCE LEHMAN

*Attesting Officer*

*Commissioner of Patents and Trademarks*